US009632465B2

(12) United States Patent
Suzuki

(10) Patent No.: US 9,632,465 B2
(45) Date of Patent: Apr. 25, 2017

(54) FIXING DEVICE

(71) Applicant: Brother Kogyo Kabushiki Kaisha, Nagoya-shi, Aichi-ken (JP)

(72) Inventor: Noboru Suzuki, Komaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/054,387

(22) Filed: Feb. 26, 2016

(65) Prior Publication Data

US 2016/0252856 A1 Sep. 1, 2016

(30) Foreign Application Priority Data

Feb. 27, 2015 (JP) ..... 2015-037900

(51) Int. Cl.
*G03G 15/20* (2006.01)

(52) U.S. Cl.
CPC ..... *G03G 15/2053* (2013.01); *G03G 15/2017* (2013.01); *G03G 2215/2003* (2013.01); *G03G 2215/2035* (2013.01)

(58) Field of Classification Search
CPC ..... G03G 15/2017; G03G 15/2053; G03G 2215/2003
See application file for complete search history.

(56) References Cited

U.S. PATENT DOCUMENTS 9,052,658 B2 6/2015 Uchitani et al.
2002/0071700 A1* 6/2002 Nishitani ..... G03G 15/2039 399/328
2010/0158587 A1 6/2010 Shin
2011/0318074 A1* 12/2011 Hiramatsu ..... G03G 15/2007 399/329
2012/0008971 A1 1/2012 Lee et al.
2013/0209125 A1 8/2013 Uchitani et al.
2014/0270820 A1* 9/2014 Saito ..... G03G 15/2039 399/33
2015/0104230 A1 4/2015 Uchitani et al.
2015/0346663 A1* 12/2015 Yamagishi ..... G03G 15/2064 399/329
2016/0170338 A1* 6/2016 Tateishi ..... G03G 15/2053 399/329

FOREIGN PATENT DOCUMENTS

JP 2013-164438 A 8/2013

* cited by examiner

*Primary Examiner* — David Gray
*Assistant Examiner* — Carla Therrien
(74) *Attorney, Agent, or Firm* — Banner & Witcoff, Ltd.

(57) ABSTRACT

A fixing device includes an endless belt, a nip member elongated in a longitudinal direction and having a first surface contactable to an inner peripheral surface of the endless belt and a second surface opposite to the first surface, a backup member configured to nip the endless belt with the nip member and form a nip portion between the backup member and the endless belt, a heater disposed inside the endless belt and elongated in the longitudinal direction, a reflection member disposed between the nip member and the heater and configured to reflect radiation heat from the heater, and a heat sensitive element configured to detect a temperature, the heat sensitive element being disposed between the reflection member and the nip member and facing the second surface of the nip member.

18 Claims, 8 Drawing Sheets

FIXING DEVICE

CROSS-REFERENCE TO RELATED APPLICATION

This application claims priority from Japanese Patent Application No. 2015-037900 filed on Feb. 27, 2015, the entire subject-matter of which is incorporated herein by reference.

TECHNICAL FIELD

The disclosure relates to a fixing device configured to heat-fix a developer image on a recording sheet.

BACKGROUND

There has been known a fixing device having an endless belt, a nip member configured to contact an inner peripheral surface of the endless belt, a pressing roller configured to nip the endless belt between the pressing roller and the nip member and to form a nip portion between the pressing roller and the endless belt and a temperature sensor disposed outside the endless belt.

SUMMARY

One illustrative aspect of the disclosure provides a fixing device comprising: an endless belt; a nip member that is elongated in a longitudinal direction, the nip member having a first surface contactable to an inner peripheral surface of the endless belt and a second surface opposite to the first surface; a backup member configured to nip the endless belt with the nip member and form a nip portion between the backup member and the endless belt; a heater that is disposed inside the endless belt and is elongated in the longitudinal direction; a reflection member disposed between the nip member and the heater and configured to reflect radiation heat from the heater; and a heat sensitive element configured to detect a temperature, the heat sensitive element being disposed between the reflection member and the nip member and facing the second surface of the nip member.

According to the above configuration, the heat sensitive element is disposed between the reflection member and the nip member, and is also disposed to face the second surface that is opposite to the first surface of the nip member contactable the inner peripheral surface of the endless belt. Therefore, as compared to a configuration where the temperature sensor is provided outside the endless belt, it is possible to accurately detect a temperature in the vicinity of the nip portion by the heat sensitive element.

Another illustrative aspect of the disclosure provides a fixing device comprising: an endless member; a nip member having a first surface contactable to an inner peripheral surface of the endless member and a second surface opposite to the first surface; a backup member configured to nip the endless member with the nip member and form a nip portion between the backup member and the endless member; a heater disposed inside the endless member; a mirror disposed between the nip member and the heater; and a temperature sensor comprising a heat sensitive element configured to detect a temperature, the heat sensitive element being disposed between the mirror and the nip member.

Still another illustrative aspect of the disclosure provides a fixing device comprising: an endless member; a nip member having a first surface contactable to an inner peripheral surface of the endless member and a second surface opposite to the first surface; a backup member configured to nip the endless member with the nip member and form a nip portion between the backup member and the endless member; a heater disposed inside the endless member; a mirror disposed between the nip member and the heater and configured to reflect radiation heat from the heater; and a thermal cut-off member electrically coupled to the heater, at least a portion of the thermal cut-off member being disposed between the mirror and the nip member.

According to the disclosure, it is possible to detect the temperature in the vicinity of the nip portion with precision.

BRIEF DESCRIPTION OF THE DRAWINGS

FIG. 3 is an exploded perspective view of a nip plate and the like;

DETAILED DESCRIPTION

According to the above-described related art, since the temperature sensor is disposed outside the endless belt, it is not possible accurately detect a temperature in the vicinity of the nip portion.

Illustrative aspects of the disclosure provide a fixing device capable of detecting a temperature in the vicinity of a nip portion with precision.

Hereinafter, illustrative embodiments of the disclosure will be described in detail with reference to the drawings. In below descriptions, the upper and lower direction of FIG. 1 indicates the upper and lower direction, and the respective directions are described on the basis of the front, which is the right in FIG. 1, the rear, which is the left in FIG. 1, the left side, which is the front side in FIG. 1, and the right side, which is the inner side in FIG. 1, unless otherwise mentioned.

Figure 1:
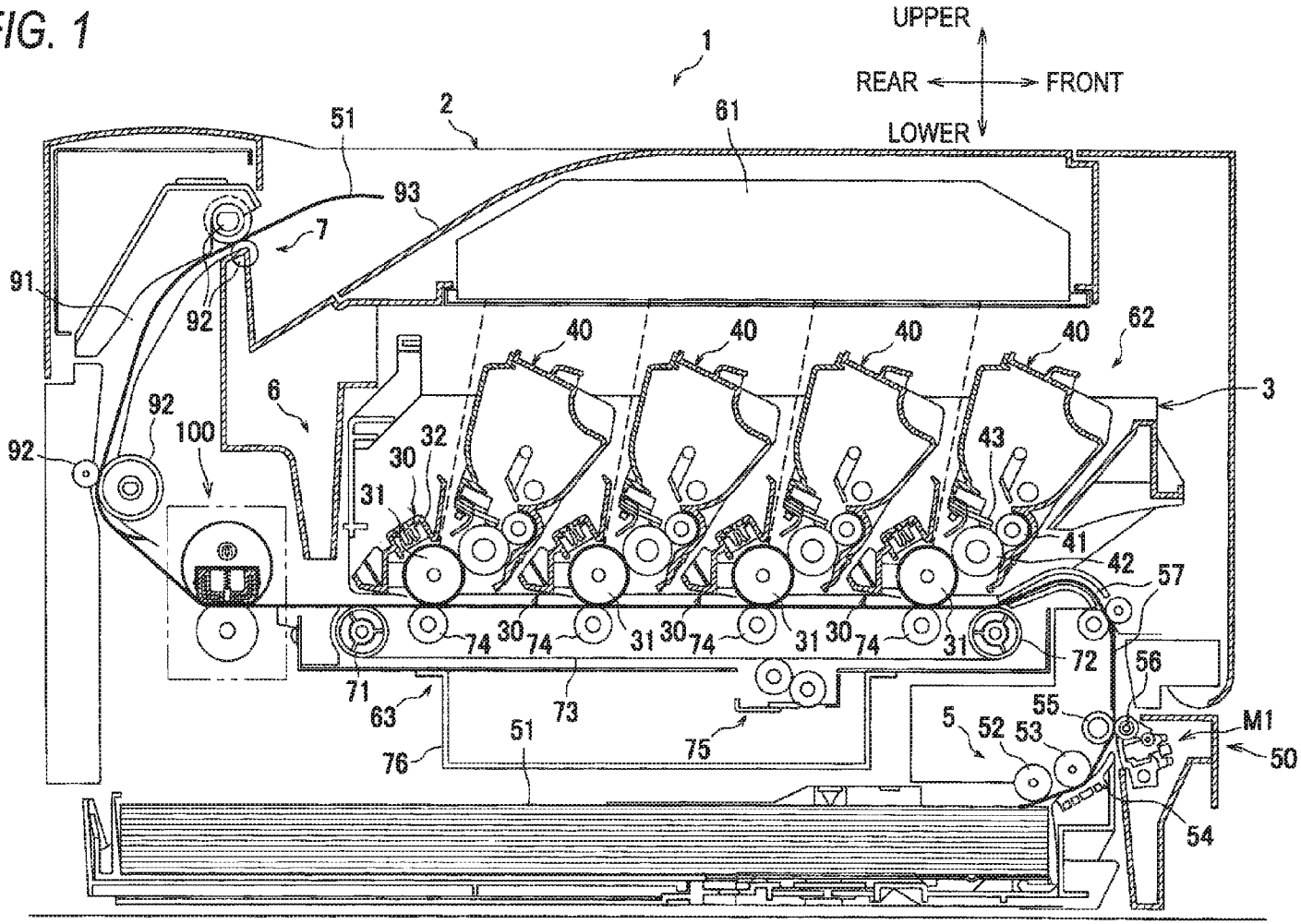
FIG. 1 is a sectional view depicting a color laser printer having a fixing device according to an illustrative embodiment of the disclosure.

As shown in FIG. 1, a color laser printer 1 mainly has, in a main body housing 2, a feeder unit 5 configured to feed a sheet 51, an image forming unit 6 configured to form an image on the fed sheet 51, and a sheet discharging unit 7 configured to discharge the sheet 51 having an image formed thereon.

The feeder unit 5 includes, at a lower part in the main body housing 2, a sheet feeding tray 50 configured to be attached and detached to and from the main body housing 2 from the front by a slide operation and a feeder mechanism M1 configured to send sheets 51 in the sheet feeding tray 50 toward the image forming unit 6.

The feeder mechanism M1 includes a pick-up roller S2, a separation roller 53, a separation pad 54 and the like provided in the vicinity of a front end portion of the sheet feeding tray 50, and the sheets 51 in the sheet feeding tray 50 are separated one by one and conveyed upwards by the corresponding members. The sheet 51 conveyed upwards passes between a paper powder removing roller 55 and a pinch roller 56 and then a conveying path 57 including a wall member and the like (not shown), is direction-changed rearwards and is then supplied onto a conveyor belt 73, which will be described later.

The image forming unit 6 includes a scanner unit 61, a process unit 62, a transfer unit 63 and a fixing device 100.

The scanner unit 61 is provided at an upper part of the main body housing 2, and has a laser light emitting part, a polygon mirror, and a plurality of lenses and reflectors, which are not shown. In the scanner unit 61, laser emitted from the laser light emitting part in correspondence of respective colors of cyan, magenta, yellow and black is scanned in the left and right direction with the polygon mirror, is passed through or reflected on the plurality of lenses and reflectors and is then irradiated to each photosensitive drum 31.

The process unit 62 is disposed below the scanner unit 61 and above the feeder unit 5, and has a photosensitive unit 3 configured to be moveable in the front and rear direction with respect to the main body housing 2. The photosensitive unit 3 has drum sub-units 30 and developing cartridges 40 mounted to the drum sub-units 30.

The drum sub-unit 30 has a photosensitive drum 31, a scorotron-type charger 32 and the like, which have been known.

The developing cartridge 40 has toner, which is an example of the developer, accommodated therein, and has also a supply roller 41, a developing roller 42, a layer thickness regulation blade 43 and the like.

The process unit 62 functions as follows. The toner in the developing cartridge 40 is supplied to the developing roller 42 by the supply roller 41. At this time, the toner is friction-charged between the supply roller 41 and the developing roller 42. The toner supplied to the developing roller 42 is rubbed by the layer thickness regulation blade 43 as the developing roller 42 is rotated, so that it is carried as a thin layer having a predetermined thickness on a surface of the developing roller 42.

In the drum sub-unit 30, the scorotron-type charger 32 uniformly charges the photosensitive drum 31 by corona discharge. The laser from the scanner unit 61 is irradiated to the charged photosensitive drum 31, so that an electrostatic latent image is formed on the photosensitive drum 31.

After that, the toner carried on the developing roller 42 is supplied to the electrostatic latent image on the photosensitive drum 31. Thereby, the electrostatic latent image on the photosensitive drum 31 becomes visible, and a toner image is carried on the surface of the photosensitive drum 31 by reversal developing, in correspondence to the toner of each color.

The transfer unit 63 has a driving roller 71, a driven roller 72, a conveyor belt 73, transfer rollers 74 and a cleaning unit 75.

The driving roller 71 and the driven roller 72 are disposed in parallel with being spaced back and forth, and the conveyor belt 73, which is an endless belt, is wound onto the rollers. The conveyor belt 73 is contacted at its outer surface to the respective photosensitive drums 31. At an inner side of the conveyor belt 73, the transfer rollers 74 configured to nip the conveyor belt 73 between the transfer rollers and the respective photosensitive drums 31 are disposed. The transfer rollers 74 are applied with a transfer bias. Upon formation of an image, the sheet 51 conveyed by the conveyor belt 73 is nipped between the photosensitive drums 31 and the transfer rollers 74 and the toner images on the photosensitive drums 31 are transferred to the sheet 51.

The cleaning unit 75 is disposed below the conveyor belt 73 and is configured to remove the toner attached to the conveyor belt 73 and to drop the removed toner to a toner storage unit 76 disposed below.

The fixing device 100 is provided at the rear of the transfer unit 63 and is configured to heat-fix the toner images transferred to the sheet 51 onto the sheet 51. The fixing device 100 will be described in detail later.

In the sheet discharging unit 7, a sheet discharge-side conveying path 91 of the sheet 51 is configured by a wall member and the like (not shown) and is formed to extend upwards from an exit of the fixing device 100 and to reverse forwards. On the way of the sheet discharge-side conveying path 91, a plurality of conveying rollers 92 configured to convey the sheet 51 is disposed. On an upper surface of the main body housing 2, a sheet discharging tray 93 configured to accumulate thereon the printed sheet 51 is formed. The sheet 51 discharged from the sheet discharge-side conveying path 91 by the conveying rollers 92 is accumulated on the sheet discharging tray 93.

Figure 2:
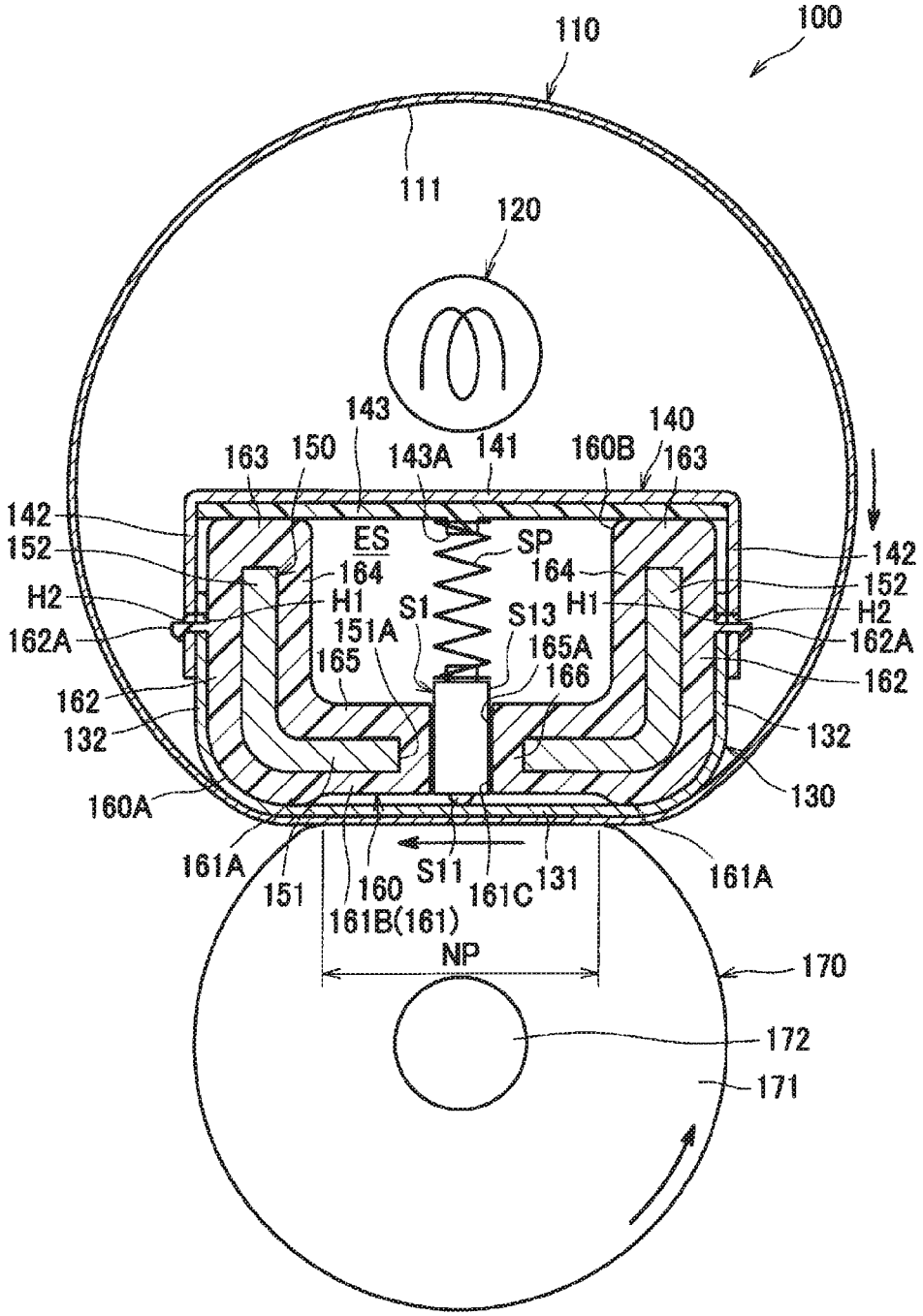
FIG. 2 is a sectional view depicting the fixing device.
Figure 3:
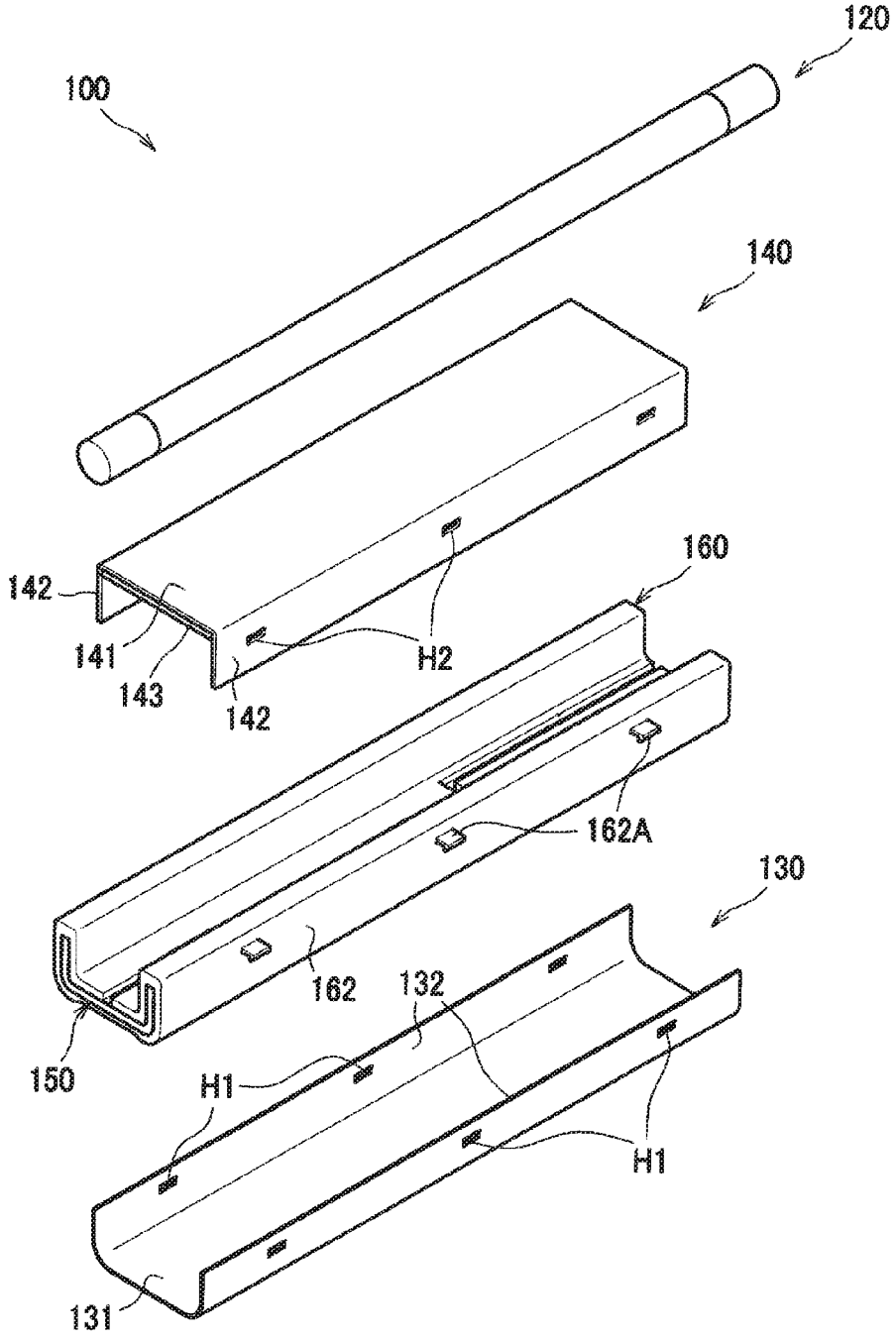

As shown in FIGS. 2 and 3, the fixing device 100 mainly has a fixing belt 110, which is an example of the endless belt, a halogen lamp 120, which is an example of the heater, a nip plate 130, which is an example of the nip member, a reflection plate 140, which is an example of the reflection member, a stay 150, an adiabatic member 160, and a pressing roller 170, which is an example of the backup member.

In below descriptions, a conveying direction (substantially front and rear direction) of the sheet 51 is simply referred to as 'conveying direction', and a width direction (substantially left and right direction) of the fixing belt 110 is simply referred to as 'width direction.' The conveying direction corresponds to a rotating direction of a portion of the fixing belt 110 contacting the nip plate 130, i.e., a moving direction, in other words, a moving direction of the fixing belt 110 at a nip portion NP (which will be described later). The width direction of the fixing belt 110 follows a direction along which a rotating axis of the pressing roller 170 extends.

The fixing belt 110 is an endless (cylindrical) belt having heat resistance and flexibility and is configured to be rotatable, and both end portions thereof in the axis direction are guided by side guides (not shown). An inner peripheral surface 111 of the fixing belt 110 is applied with grease for reducing a frictional resistance against the nip plate 130 and the like.

The fixing belt 110 may be configured as a metal belt having a metallic base material and a resin covered on an outer periphery of the base material or may have a configuration where a rubber layer is provided on a surface of metal or a non-metallic protection layer is further provided on a surface of the rubber layer by fluorine coating or the like. The base material of the fixing belt 110 may be a resin such as polyimide resin or the like.

The halogen lamp 120 is a heating member configured to heat the fixing belt 110, thereby heating the toner on the sheet 51. The halogen lamp 120 is disposed at a predetermined interval from the fixing belt 110 inside the fixing belt 110.

The nip plate 130 is disposed below the halogen lamp 120, and is in contact with the inner peripheral surface 111 of the fixing belt 110. The nip plate 130 is elongated in a longitudinal direction. Incidentally, 'elongated in a longitudinal direction' means that a size of the member (e.g., the nip plate 130) in the longitudinal direction is larger than a size of the member (e.g., the nip plate 130) in an arbitrary orthogonal direction orthogonal to the longitudinal direction of the member. The nip plate 130 includes a metal plate, and is formed by bending the metal plate into a substantial U shape, as seen from a section. The metal plate may be an aluminum plate or a SUS plate.

More specifically, the nip plate 130 mainly has a base part 131 extending in the conveying direction and sidewall parts 132 extending from each end portion of the base part 131 in the conveying direction toward a direction getting away from the pressing roller 170, on a section orthogonal to the width direction. Herein, the direction getting away from the pressing roller 170 indicates a direction intersecting with the conveying direction of the recording sheet at the nip portion NP and getting away from the pressing roller 170.

The base part 131 has a rectangular plain plate shape elongated in the width direction, and a lower surface thereof is in contact with the inner peripheral surface 111 of the fixing belt 110.

The sidewall part 132 has a rectangular plain plate shape elongated in the width direction and is formed at appropriate portions with a plurality of insertion holes H1 into which claw portions 162A of the adiabatic member 160 are inserted, which will be described later.

The reflection plate 140 is a member configured to reflect radiation heat (light) from the halogen lamp 120 toward the inner peripheral surface 111 of the fixing belt 110 and to directly irradiate the same to the inner peripheral surface 111, and is disposed between the halogen lamp 120 and the nip plate 130 (specifically, the base part 131) inside the fixing belt 110. In other words, the reflection plate 140 is disposed below the halogen lamp 120 and above the base part 131, and is configured to reflect the radiation heat from the halogen lamp 120 upwards, i.e., in a direction getting away from the nip plate 130. That is, the radiation heat reflected on a reflection surface of the reflection plate 140 is irradiated in the direction getting away from the nip plate 130.

The reflection plate 140 includes a metal plate, and is formed by bending the metal plate into a substantial U shape, as seen from a section. The metal plate may be an aluminum plate or a SUS plate.

More specifically, the reflection plate 140 mainly has a base part 141 extending in the conveying direction and sidewall parts 142 extending from each end portion of the base part 141 in the conveying direction toward a direction facing toward the pressing roller 170, on a section orthogonal to the width direction. Herein, the direction facing toward the pressing roller 170 indicates a direction intersecting with the conveying direction of the recording sheet at the nip portion NP and facing toward the pressing roller 170.

Figure 5:
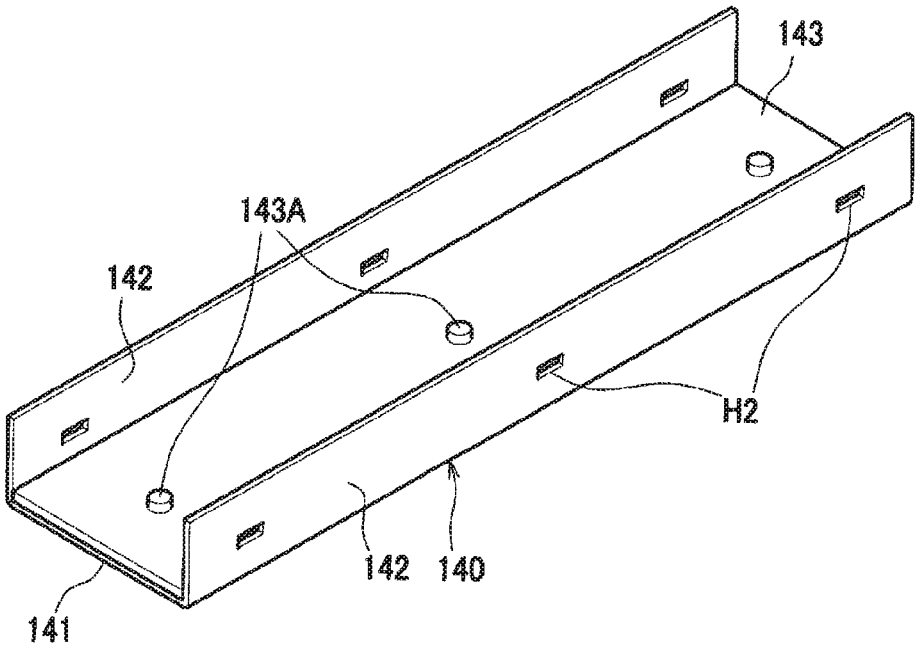
FIG. 5 is a perspective view of a reflection plate, as seen from below.

A lower surface of the base part 141, i.e., an inner surface facing a space ES (which will be described later) is provided with a fourth adiabatic member 143 made of resin, which is an example of a portion of the second adiabatic member. The fourth adiabatic member 143 is formed to cover the entire lower surface of the base part 141 and is arranged thereon with three support projections 143A configured to support compression coil springs SP, which are an example of the pressing member, at a predetermined pitch in the width direction (refer to FIG. 5).

Each sidewall part 142 of the base part 141 is configured to overlap with each sidewall part 132 of the nip plate 130 from an outer side in the conveying direction, i.e., from the fixing belt 110-side, and is disposed close to each sidewall part 132 of the nip plate 130. Each sidewall part 142 of the base part 141 has a plain plate shape perpendicular to the conveying direction and is formed at its appropriate portions with a plurality of insertion holes H2 into which the claw portions 162A of the adiabatic member 160 are inserted, which will be described later.

The stay 150 is a metallic frame for securing stiffness of the nip plate 130, is disposed at an opposite side of the halogen lamp 120 with respect to the reflection plate 140, and is configured to support the nip plate 130 via the adiabatic member 160. The stay 150 is formed by bending metal having relatively high stiffness, for example, a steel plate into a substantial U shape, as seen from a section.

More specifically, the stay 150 has a recessed shape opening toward the reflection plate 140, and mainly has a base part 151 extending in the conveying direction and sidewall parts 152 extending from each end portion of the base part 151 in the conveying direction toward the direction getting away from the pressing roller 170, on a section orthogonal to the width direction. The base part 151 of the stay 150 is formed with first through-holes 151A penetrating therethrough from the upper toward the lower, i.e., from the reflection plate 140-side toward the nip plate 130, more particularly, from the halogen lamp 120-side toward the pressing roller 170. The three first through-holes 151A are formed at an interval in the width direction (refer to portions corresponding to second through-holes 161C (which will be described later) in FIG. 4).

The stay 150 is longer than the nip plate 130 and the reflection plate 140 in the width direction, and both end portions thereof are fixed to side guides (not shown).

Each side guide is pressed downwards by an elastic member (not shown) such as a spring, so that a downward pressing force is applied to the stay 150 and is transmitted to the pressing roller 170 via the adiabatic member 160, the nip plate 130 and the fixing belt 110. In addition, a reactive force to the pressing force is generated from the pressing roller 170 and is received at the stay 150 via the fixing belt 110, the nip plate 130 and the adiabatic member 160.

To the contrary, a configuration where the pressing roller 170 is pressed upwards by an elastic member and the pressing force from the pressing roller 170 is thus received at the stay 150 via the fixing belt 110, the nip plate 130 and the adiabatic member 160 is also possible.

The adiabatic member 160 is a resin member for suppressing the heat from being transferred from the nip plate 130 and the reflection plate 140 to the stay 150, and is integrally formed with the stay 150 by insert molding so as to cover an entire circumference of the stay 150 on a section orthogonal to the width direction. Specifically, the adiabatic member 160 has a first adiabatic member 160A, a third adiabatic member 160B, which is an example of a portion of the second adiabatic member, and a fifth adiabatic member 166. The adiabatic member 160 is made of LCP (Liquid Crystal Polymer), which is a heat resistance resin, for example.

The first adiabatic member 160A is disposed between the nip plate 130 and the stay 150, and has a substantial U shape following the corresponding members, as seen from a section. More specifically, the first adiabatic member 160A mainly has a base part 161 extending in the conveying direction and sidewall parts 162 extending from each end portion of the base part 161 in the conveying direction toward the direction getting away from the pressing roller 170, on a section orthogonal to the width direction.

Each end portion 161A of the base part 161 in the conveying direction is a convex portion protruding more downwards than a central portion 161B and is in contact with the nip plate 130. Thereby, an air layer is formed between the central portion 161B and the nip plate 130.

The central portion 161B of the base part 161 is formed at positions corresponding to the three first through-holes 151A formed in the stay 150 with three second through-holes 161C (refer to FIG. 4) penetrating from the stay 150-side toward the nip plate 130.

An outer surface of the sidewall part 162, which is an outer surface in the conveying direction, is formed with a plurality of claw portions 162A protruding outwards from the outer surface in the conveying direction. The claw portion 162A protrudes outwards from the sidewall part 162 in the conveying direction, and a tip portion thereof protrudes downwards. The claw portion 162A is inserted into the insertion hole H1 of the nip plate 130 and the insertion hole H2 of the reflection plate 140, so that the tip portion thereof is engaged with the sidewall part 142 of the reflection plate 140 from an outer side.

The third adiabatic member 160B is formed to cover upper end surfaces of the sidewall parts 152 of the stay 150, inner surfaces of the sidewall parts 152 in the conveying direction and an upper surface of the base part 151. Herein, according to this illustrative embodiment, a space ES surrounded by a bottom of the stay 150 (the upper surface of the base part 151), which has a recessed shape, a pair of side surfaces of the stay 150 (inner surfaces of the sidewall parts 152), parts virtually extending from the pair of side surfaces to the reflection plate 140 and the reflection plate 140 is formed. The third adiabatic member 160B is configured to cover the surfaces of the stay 150 facing the space ES.

Specifically, the third adiabatic member 160B has a pair of first parts 163 configured to cover the upper end surfaces of the front and rear sidewall parts 152, a pair of second parts 164 configured to cover the inner surfaces of the front and rear sidewall parts 152 in the conveying direction, and a third part 165 configured to cover the upper surface of the base part 151.

An outer end portion of the first part 163 in the conveying direction is integrally formed with the sidewall part 162 of the first adiabatic member 160A and an inner end portion of the first part 163 in the conveying direction is integrally formed with the second part. An upper surface of the first part 163 is in contact with the fourth adiabatic member 143.

The second part 164 extends downwards from the first part 163 to the third part 165 along the sidewall part 152 and is integrally formed with the third part 165. The third part 165 is formed over the substantially entire upper surface of the base part 151, and has three third through-holes 165A (refer to FIG. 4) penetrating downwards from the upper, i.e., from the reflection plate 140-side toward the nip plate 130 at positions corresponding to the three first through-holes 151A formed in the base part 151.

The fifth adiabatic member 166 has a cylindrical shape following an inner peripheral surface of the first through-hole 151A, an upper end portion thereof is integrally connected to a surrounding of the third through-hole 165A of the third part 165, and a lower end portion is integrally connected to a surrounding of the second through-hole 161C of the base part 161 of the first adiabatic member 160A. An inner peripheral surface of the fifth adiabatic member 166 is connected to be substantially flush with an inner peripheral surface of the second through-holes 161C and an inner peripheral surface of the third through-hole 165A to be substantially flush, and a rectangular temperature sensor (refer to FIG. 4) such as a center thermistor S1 is inserted in these inner peripheral surfaces.

Figure 4:
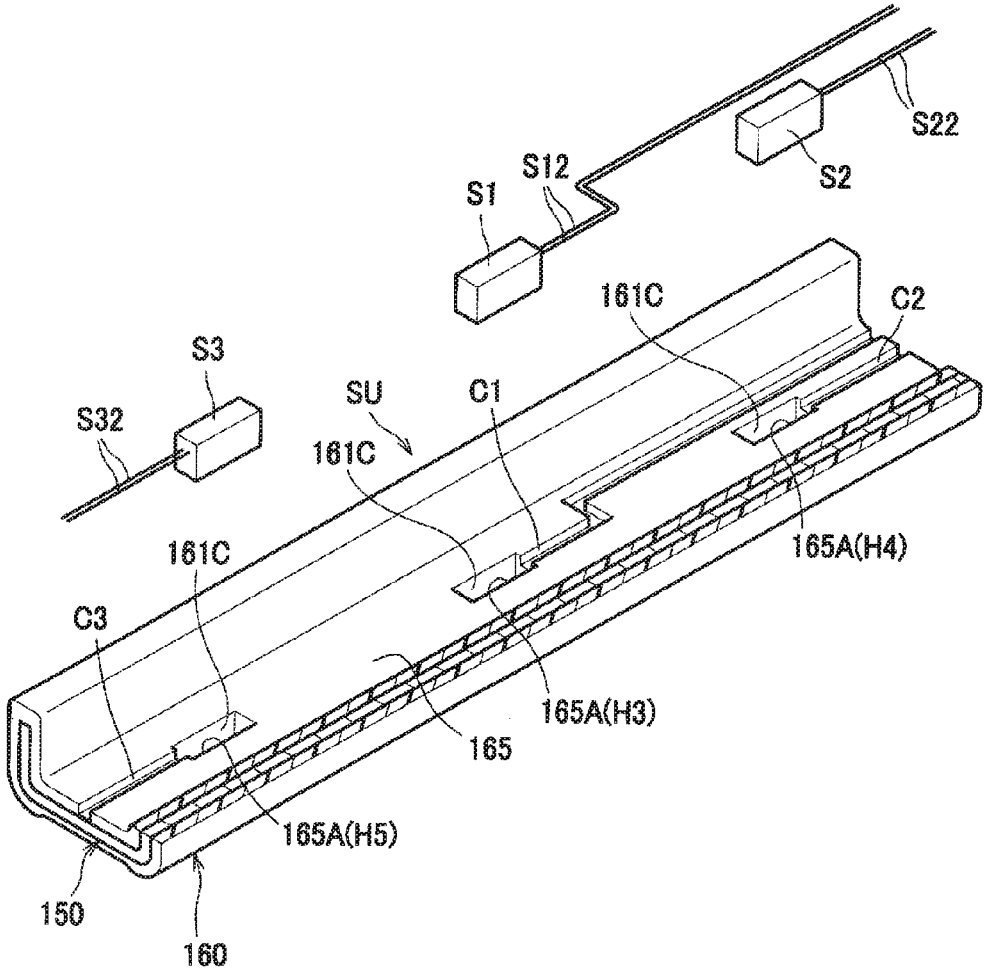
FIG. 4 is a perspective view depicting a relation of respective attachment holes of a stay unit and respective temperature sensors.

As shown in FIG. 4, a stay unit SU including the stay 150 and the adiabatic member 160 is formed with three rectangular attachment holes H3, H4, H5, which are through-holes, for attaching three rectangular temperature sensors such as a center thermistor S1. Each of the attachment holes H3 to H5 is configured by the third through-hole 165A, the hole (the inner peripheral surface) penetrating the fifth adiabatic member 166, and the second through-hole 161C. In FIG. 4, one sidewall part 152 of the stay 150 and a portion of the adiabatic member 160 at the periphery of the sidewall part 152 are shown to be broken for convenience sake.

Specifically, the three attachment hole H3 to H5 are respectively provided at a substantial central portion of the stay unit SU in the width direction and at respective end portions of the stay unit SU in the width direction, and are configured to moveably support three temperature sensors such as a center thermistor S1 in the upper and lower direction.

In the attachment hole H3 formed at the substantial central portion in the width direction, a center thermistor S1, which is an example of the temperature sensor, is inserted. Herein, the center thermistor S1 is a sensor for detecting a temperature of a substantial central portion of the nip plate 130 in the width direction. As shown in FIG. 2, a lower surface of the center thermistor S1 is provided with a heat sensitive element S11 configured to contact the nip plate 130 via a protective member (e.g., a heat-resistant film, a protective sheet, etc.) and to detect a temperature of the nip plate 130. The heat sensitive element S11 is disposed between the reflection plate 140 and the nip plate 130 so that it faces the upper surface of the nip plate 130, and is also disposed at an inner side of the nip portion NP in the conveying direction. In other words, the heat sensitive element S11 is disposed to face a back surface of the surface of the nip plate 130 in contact with the inner peripheral surface 111 of the fixing belt 110, and is also disposed at an inner side of the nip portion NP in the conveying direction. Also, the heat sensitive element S11 is in contact with the nip plate 130 and is configured to nip the nip plate 130 and the fixing belt 110 between the heat sensitive element and the pressing roller 170. A casing of the temperature sensor S1 is made of resin. The casing accommodates therein components such as a connecting member for coupling the heat sensitive element S11 and a wiring S12 (which will be described later). The casing may be referred as a supporting member configured to support the heat sensitive element S11. The supporting member is configured to press the heat sensitive element S11 toward the nip plate 130 by receiving pressing force from the compression coil spring SP. Incidentally, the supporting member may be configured to support and press the heat sensitive element S11 via an elastic member such as a sponge.

Again referring to FIG. 4, the central attachment hole H3 is connected with a first recess for wiring C1, which is an example of the wiring holding part for holding a wiring S12 of the center thermistor S1 and taking out the wiring from an inner side toward an outer side of the stay unit SU in the width direction. Specifically, the first recess for wiring C1 is formed in the third part 165 of the adiabatic member 160 so that it extends from the central attachment hole H3 toward one side (a right side in FIG. 4) in the width direction, extends toward one side in the conveying direction, extends toward one side in the width direction and opens toward an outer side in the width direction.

In the attachment hole H4 provided in the vicinity of one end portion in the width direction, a side thermistor S2 that is an example of a side temperature sensor is inserted. Herein, the side thermistor S2 is a sensor for detecting a temperature in the vicinity of one end portion of the nip plate 130 in the width direction. A lower surface of the side thermistor S2 is provided with a heat sensitive element (not shown) having the substantially same function as the heat sensitive element S11. The heat sensitive element (not shown) is also disposed to face the back surface of the surface of the nip plate 130 in contact with the inner peripheral surface 111 of the fixing belt 110 and is disposed at the inner side of the nip portion NP in the conveying direction, like the heat sensitive element S11.

The attachment hole H4 provided at one side is connected with a second recess for wiring C2, which is an example of the wiring holding part for holding a wiring S22 of the side thermistor S2 and taking out the wiring from an inner side toward an outer side of the stay unit SU in the width direction. Specifically, the second recess for wiring C2 is formed in the third part 165 of the adiabatic member 160 so that it extends from the attachment hole H4 provided at one side toward one side in the width direction and opens toward an outer side in the width direction.

In the attachment hole H5 provided in the vicinity of the other end portion in the width direction, a thermostat S3 is inserted. Herein, the thermostat S3 is provided on a circuit configured to feed power to the halogen lamp 120 and is configured to cut off the power feeding to the halogen lamp 120 when the temperature of the nip plate 130 becomes a predetermined value or greater. A lower surface of the thermostat S3 is provided with a heat sensitive element (not shown) having the substantially same function as the heat sensitive element S11. The heat sensitive element (not shown) is also disposed between the nip plate 130 and the reflection plate 140 and is also disposed at the inner side of the nip portion NP in the conveying direction, like the heat sensitive element S11. The heat sensitive element, which is substantially the same as the heat sensitive element S11, is in contact with the nip plate 130 with a protection member (not shown) being interposed therebetween. The thermostat S3 is one example of a thermal cut-off member. Incidentally, a fuse may be used as the thermal cut-off member. The protection member is made of a film, for example. In the meantime, the protection member may not be provided.

The attachment hole H5 provided at the other side is connected with a third recess for wiring C3, which is an example of the wiring holding part for holding a wiring S32 of the thermostat S3 and taking out the wiring from an inner side toward an outer side of the stay unit SU in the width direction. Specifically, the third recess for wiring C3 is formed in the third part 165 of the adiabatic member 160 so that it extends from the attachment hole H5 provided at the other side toward the other side in the width direction and opens toward an outer side in the width direction. Each of the wirings S12, S22, S32 has an electric wire covered with a resin having heat resistance, for example.

As shown in FIG. 2, the center thermistor S1 has an end portion S13 protruding upwards beyond the base part 151 of the stay 150, i.e., from the second through-hole 161C toward the first through-hole 151A. The end portion S13 is disposed in the space ES surrounded by the stay 150 and the reflection plate 140. In other words, the end portion S13 is disposed in the space surrounded by the third adiabatic member 160B and the fourth adiabatic member 143 and is covered by the adiabatic members 160B, 143. More specifically, the end portion S13 is disposed in the space surrounded by the nip plate 130 and the respective adiabatic members 160A, 166, 160B, 143. In the meantime, the side thermistor S2 and the thermostat S3 have also end portions disposed in the space.

The compression coil spring SP configured to press the center thermistor S1 toward the nip plate 130 is provided between the center thermistor S1 and the fourth adiabatic member 143. The same compression coil springs SP are also provided between the side thermistor S2 and the fourth adiabatic member 143 and between the thermostat S3 and the fourth adiabatic member 143, respectively.

The pressing roller 170 is a member configured to interpose the fixing belt 110 between the pressing roller 170 and the nip plate 130 and to form the nip portion NP between the pressing roller 170 and the fixing belt 110, and is disposed below the nip plate 130. The pressing roller 170 has a cylindrical roller main body 171 and a shaft 172 inserted into the roller main body 171 and configured to be rotatable together with the roller main body 171. The roller main body 171 is configured to be elastically deformable.

The pressing roller 170 is configured to rotate as a driving force is transmitted thereto from a motor (not shown) provided in the main body housing 2. The pressing roller 170 is rotated, so that the fixing belt 110 is correspondingly rotated by a frictional force against the fixing belt 110 (or the sheet 51).

According to the above illustrative embodiment, following effects can be accomplished.

Since the heat sensitive element S11 of the center thermistor S1 is disposed between the reflection plate 140 and the nip plate 130 and to face the back surface of the surface of the nip plate 130 in contact with the inner peripheral surface 111 of the fixing belt 110, it is possible to accurately detect the temperature of the nip portion NP by the heat sensitive element S11 of the center thermistor S1, as compared to a configuration where the center thermistor is provided outside the fixing belt. The corresponding effect is also accomplished for the side thermistor S2 and the thermostat S3.

Since the heat sensitive element S11 is disposed at the inner side of the nip portion NP in the conveying direction, it is possible to detect the temperature of the nip portion NP with higher precision.

Since the center thermistor S1 and the like are disposed in the respective attachment holes H3 to H5 formed in the adiabatic member 160, it is possible to favorably hold the center thermistor S1 and the like by the respective attachment holes H3 to H5. In other words, the parts of the center thermistor S1 and the like, which are disposed in the first through-holes 151A formed in the stay 150, are favorably held by the first through-holes 151A via the fifth adiabatic member 166 disposed in the first through-holes 151A, respectively. Also, the parts of the center thermistor S1 and the like, which are disposed in the second through-holes 161C formed in the first adiabatic member 160A, are favorably held by the second through-holes 161C, respectively.

The third adiabatic member 160B is provided on the inner surface of the stay 150 facing the space ES, so that the heat from the reflection plate 140 is difficult to be transferred to the center thermistor S1 and the like via the stay 150. Therefore, it is possible to favorably detect the temperature by the center thermistor S1 and the like.

The fourth adiabatic member 143 is provided on the inner surface of the reflection plate 140 facing the space ES, so that the heat from the reflection plate 140 is difficult to be transferred to the center thermistor S1 and the like. Therefore, it is possible to favorably detect the temperature by the center thermistor S1 and the like.

Since the end portion S13 of the center thermistor S1 is covered by the third adiabatic member 160B and the fourth adiabatic member 143, it is possible to block the heat to be transferred to the end portion S13 of the center thermistor S1 by the third adiabatic member 160B and the fourth adiabatic member 143 and to favorably detect the temperature by the center thermistor S1. The corresponding effect is also accomplished for the side thermistor S2 and the thermostat S3.

Since the entire circumference of the stay 150 is covered by the first adiabatic member 160A and the third adiabatic member 160B on the section orthogonal to the width direction, it is possible to suppress the temperature of the stay 150 from excessively increasing by the first adiabatic member 160A and the third adiabatic member 160B. In this way, the temperature of the stay 150 is suppressed from excessively increasing, so that it is possible to suppress the heat of the stay 150 from being transferred to the center thermistor S1 and the like. Therefore, it is possible to favorably detect the temperature by the center thermistor S1 and the like.

Since the first adiabatic member 160A, the third adiabatic member 160B and the fifth adiabatic member 166 are integrally formed with the stay 150, it is possible to easily assemble the fixing device 100, as compared to a configuration where each adiabatic member is configured as a separate member from the stay, for example.

Since the first adiabatic member 160A, the third adiabatic member 160B and the fifth adiabatic member 166 are integrally formed with the stay 150 by the insert molding, the first adiabatic member 160A, the third adiabatic member 160B, the fifth adiabatic member 166 and the stay 150 can be easily integrated.

Since the heat sensitive element S11 of the center thermistor S1 is in contact with the nip plate 130, it is possible to detect the temperature of the nip portion NP by the heat sensitive element S11 of the center thermistor S1 with higher precision, as compared to a configuration where the heat sensitive element is spaced from the nip plate, for example. The corresponding effect is also accomplished for the side thermistor S2 and the thermostat S3.

The compression coil spring SP configured to press the center thermistor S1 toward the nip plate 130 is provided, so that it is possible to bring the heat sensitive element S11 of the center thermistor S1 into favorable contact with the nip plate 130. Therefore, it is possible to detect the temperature of the nip portion NP by the heat sensitive element S11 of the center thermistor S1 with higher precision. The corresponding effect is also accomplished for the side thermistor S2 and the thermostat S3.

The fifth adiabatic member 166 is provided in the first through-hole 151A, so that it is possible to suppress the heat of the stay 150 from being transferred to the center thermistor S1 and the like. Therefore, it is possible to favorably detect the temperature by the center thermistor S1 and the like.

Since the center thermistor S1 and the like are disposed in the space surrounded by the nip plate 130 and the respective adiabatic members 160A, 166, 160B, 143, it is possible to suppress the heat of the reflection plate 140 from being transferred to the center thermistor S1 and the like. Therefore, it is possible to favorably detect the temperature by the center thermistor S1 and the like.

The disclosure is not limited to the above illustrative embodiment and can be used in a variety of forms to be exemplified below. In below descriptions, the members having the same structures as the illustrative embodiment are denoted with the same reference numerals, and the descriptions thereof are omitted.

Figure 6:
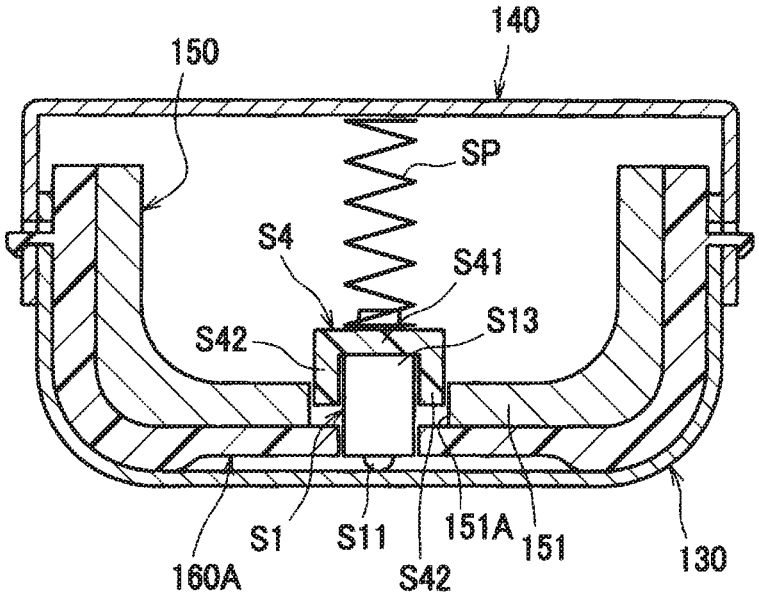
FIG. 6 is a sectional view depicting a first modified embodiment of the disclosure.

In the above illustrative embodiment, the third adiabatic member 160B is provided. However, the disclosure is not limited thereto. For example, as shown in FIG. 6, the third adiabatic member 160B may not be provided. Also, as shown in FIG. 6, the end portion S13 of the center thermistor S1 facing the reflection plate 140 may be covered with a second adiabatic member S4 for suppressing the heat from the reflection plate 140 from being transferred to the center thermistor S1.

Specifically, the end portion S13 of the center thermistor S1 more protrudes toward the reflection plate 140 than the base part 151 of the stay 150. The second adiabatic member S4 has a rectangular upper wall part S41 provided on an upper surface of the end portion S13 of the center thermistor S1 and four sidewall parts S42 extending downwards from respective end portions of the upper wall part S41 in the width direction and the conveying direction.

Each sidewall part S42 is inserted into the first through-hole 151A formed in the base part 151 of the stay 150, and is supported to be moved in the upper and lower direction by the first through-hole 151A. According to this configuration, since it is possible to block the heat to be transferred to the end portion S13 of the center thermistor S1 by the second adiabatic member S4, it is possible to favorably detect the temperature by the center thermistor S1.

Also, in this configuration, since the end portion S13 of the center thermistor S1 is protected from the heat by the second adiabatic member S4, the fourth adiabatic member 143 of the above illustrative embodiment may not be provided. That is, according to this configuration, since the second adiabatic member S4 configured to cover the end portion S13 is provided in place of the fourth adiabatic member 143 formed over the entire lower surface of the base part 141 of the reflection plate 140 in the above illustrative embodiment, it is possible to reduce an amount of the adiabatic member, so that it is possible to lighten the fixing device 100.

Figure 7:
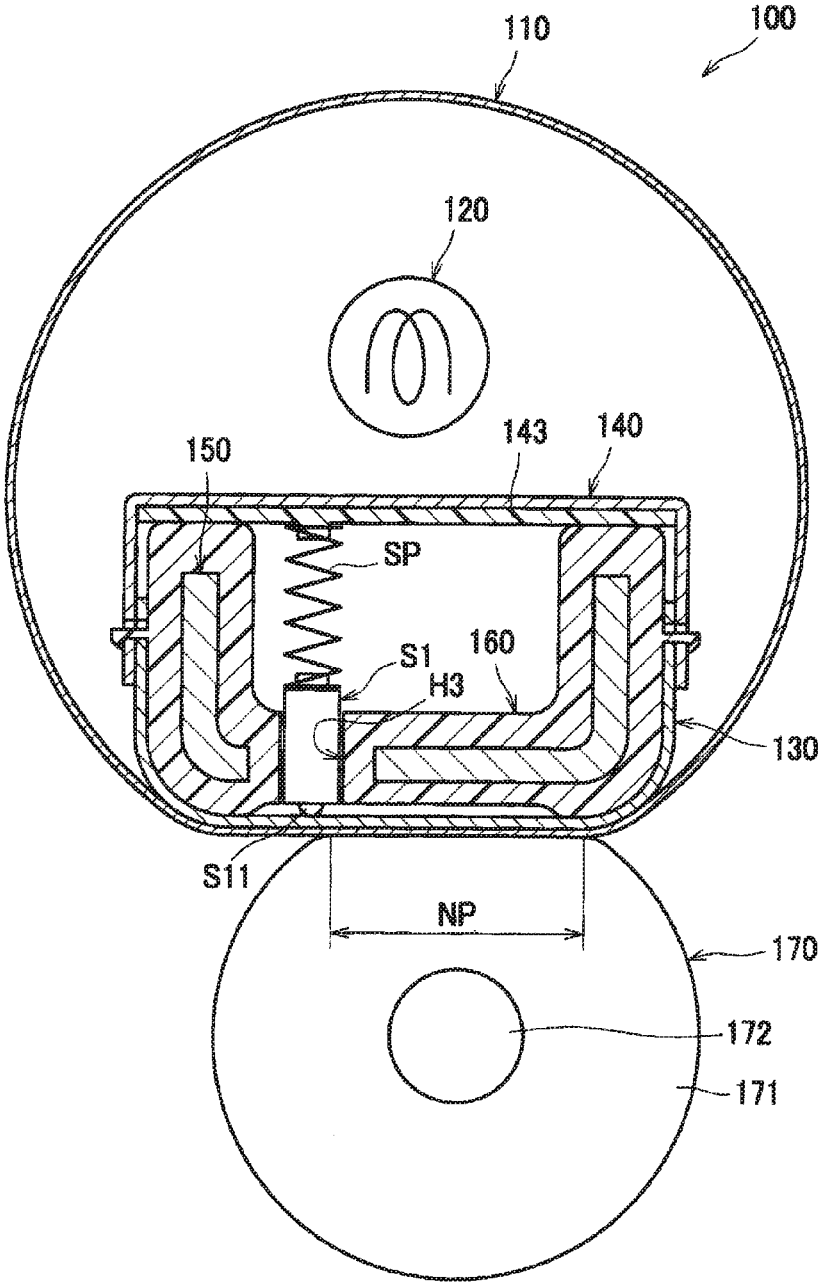
FIG. 7 is a sectional view depicting a second modified embodiment of the disclosure.

In the above illustrative embodiment, the heat sensitive element S11 is disposed in the area of the nip portion NP in the conveying direction. However, the disclosure is not limited thereto. For example, as shown in FIG. 7, the heat sensitive element S11 may be disposed at a position outside the area of the nip portion NP in the conveying direction. In this case, the attachment holes H3 to H5 (only the attachment hole H3 is shown) for attaching the temperature sensors such as the center thermistor S1 and the like may be appropriately disposed to deviate in the conveying direction.

Figure 8:
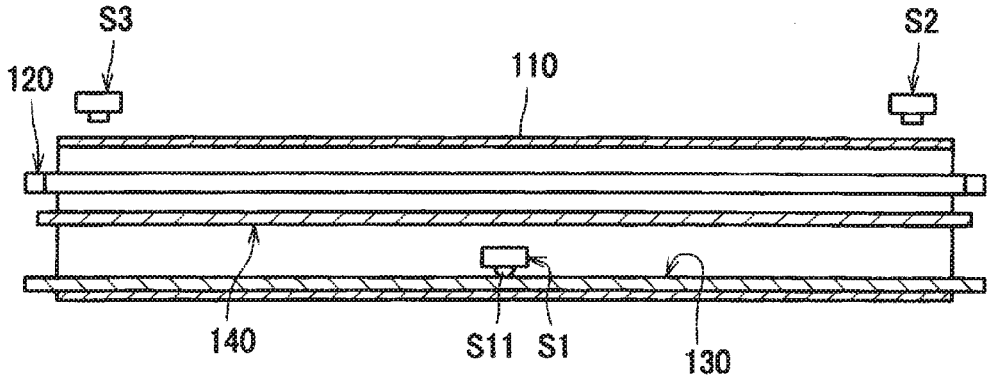
FIG. 8 is a sectional view depicting a third modified embodiment of the disclosure.

In the above illustrative embodiment, the side thermistor S2 and the thermostat S3 are disposed inside the fixing belt 110. However, the disclosure is not limited thereto. For example, as schematically shown in FIG. 8, the side thermistor S2 and the thermostat S3 may be disposed outside the fixing belt 110. That is, according to the disclosure, the heat sensitive element of at least one temperature sensor of the plurality of temperature sensors may be disposed between the nip plate 130 and the reflection plate 140 and also to face the back surface of the surface of the nip plate 130 in contact with the inner peripheral surface 111 of the fixing belt 110. FIG. 8 is a sectional view depicting the fixing belt 110, the reflection plate 140 and the nip plate 130 taken along a plane orthogonal to the conveying direction, in which the adiabatic member 160 and the like are appropriately omitted.

In the above illustrative embodiment, the fourth adiabatic member 143 is provided over the entire surface of the reflection plate 140 facing the stay 150. However, the disclosure is not limited thereto. For example, the third adiabatic member may be provided at least a part, which faces the temperature sensor, of the surface of the reflection plate facing the stay.

In the above illustrative embodiment, the heat sensitive element S11 is in contact with the nip plate 130. However, the disclosure is not limited thereto. For example, when using a non-contact temperature sensor, the heat sensitive element may be spaced from the nip plate.

In the above illustrative embodiment, the compression coil spring SP has been exemplified as the pressing member. However, the disclosure is not limited thereto. For example, the pressing member may be a plate spring, a torsion spring or the like.

In the above illustrative embodiment, the recesses C1 to C3 have been exemplified as the wiring holding part. However, the disclosure is not limited thereto. For example, the wiring holding part may be a pair of protrusions disposed to nip a wiring therebetween.

In the above illustrative embodiment, the halogen lamp 120 has been exemplified as the heater. However, the disclosure is not limited thereto. For example, the heater may be a carbon heater or the like.

In the above illustrative embodiment, the nip plate 130 and reflection plate 140 having a plate shape have been exemplified as the nip member and the reflection member. However, the disclosure is not limited thereto. For example, the nip member and the reflection member may be a member having a predetermined thickness rather than the plate shape, respectively. Further, the reflection plate 140 may be a mirror.

In the above illustrative embodiment, the disclosure has been applied to the color laser printer 1. However, the disclosure is not limited thereto. For example, the disclosure can also be applied to the other image forming apparatus, such as a copier, a complex machine or the like.

In the above illustrative embodiment, the pressing roller 170 has been exemplified as the backup member configured to nip the endless belt between the backup member and the nip member. However, the disclosure is not limited thereto. For example, a belt-type pressing member is also possible.

In the above illustrative embodiment, the stay 150 having a recessed shape on the section orthogonal to the width direction has been exemplified. However, the disclosure is not limited thereto. For example, a stay having an inverted T shape on the section orthogonal to the width direction may also be adopted. In this case, the temperature sensor may be disposed at an end portion of the stay in the conveying direction.

In the above illustrative embodiment, the third adiabatic member 160B and the fourth adiabatic member 143 configuring the second adiabatic member have been separately configured. However, the disclosure is not limited thereto. For example, the third adiabatic member and the fourth adiabatic member may be integrally configured.

In the above illustrative embodiment, the temperature sensors are positioned in the first through-holes 151A and the second through-holes 161C. However, the disclosure is not limited thereto. For example, all the temperature sensors may be positioned in the first through-holes 151A or all the temperature sensors may be positioned in the second through-holes 161C.

What is claimed is:

1. A fixing device comprising:

an endless belt;

a nip member that is elongated in a longitudinal direction, the nip member having a first surface contactable to an inner peripheral surface of the endless belt and a second surface opposite to the first surface;

a backup member configured to nip the endless belt with the nip member to form a nip portion between the backup member and the endless belt;

a heater that is disposed inside the endless belt and is elongated in the longitudinal direction;

a reflection member disposed between the nip member and the heater and configured to reflect radiation heat from the heater;

a heat sensitive element configured to detect a temperature, the heat sensitive element being disposed between the reflection member and the nip member and facing the second surface of the nip member;

a temperature sensor having the heat sensitive element;

a stay that is elongated in the longitudinal direction and is disposed at an opposite side of the heater relative to the reflection member; and a first adiabatic member that is elongated in the longitudinal direction and is disposed between the stay and the nip member, wherein the stay has a first through-hole, wherein the first adiabatic member has a second through-hole, and wherein at least a portion of the temperature sensor is disposed in the first through-hole and the second through-hole.

2. The fixing device according to claim 1, wherein a sheet is to be conveyed in a conveyance direction at the nip portion, wherein the nip portion has an upstream end in the conveyance direction and a downstream end in the conveyance direction, wherein the heat sensitive element is disposed at a downstream side from the upstream end of the nip portion in the conveyance direction and at an upstream side from the downstream end of the nip portion in the conveyance direction.

3. The fixing device according to claim 2, wherein the first adiabatic member has:

a first protrusion protruding toward the nip member and contacting the second surface the nip member; and a second protrusion that is disposed at an upstream side from the first protrusion in the conveyance direction of the sheet and contacts the second surface of the nip member, the first protrusion and the second protrusion defining a space therebetween, and wherein the heat sensitive element of the temperature sensor is disposed in the space defined by the first protrusion and the second protrusion.

4. The fixing device according to claim 3, wherein the heat sensitive element is contactable to the nip member.

5. The fixing device according to claim 1, wherein the temperature sensor has an end portion protruding with respect to a surface of the stay in a direction from the second through-hole toward the first through-hole, and wherein the fixing device further comprises a second adiabatic member covering at least a portion of the end portion of the temperature sensor.

6. The fixing device according to claim 5, wherein the reflection member has a first surface facing the heater and a second surface opposite to the first surface, wherein the stay has an inner surface defining a recessed shape opening toward the second surface of the reflection member, and wherein the fixing device further comprises a third adiabatic member covering at least a portion of the inner surface of the stay.

7. The fixing device according to claim 6, wherein the temperature sensor further comprises a wiring, and wherein the third adiabatic member has a wiring holding part that is configured to hold the wiring of the temperature sensor.

8. The fixing device according to claim 1, wherein the reflection member has a first surface facing the heater and a second surface opposite to the first surface, wherein the stay has an inner surface defining a recessed shape opening toward the second surface of the reflection member, and wherein the fixing device further comprises a fourth adiabatic member disposed between the temperature sensor and the second surface of the reflection member and covering at least a portion of the second surface of the reflection member.

9. A fixing device comprising:

an endless belt;

a nip member that is elongated in a longitudinal direction, the nip member having a first surface contactable to an inner peripheral surface of the endless belt and a second surface opposite to the first surface;

a backup member configured to nip the endless belt with the nip member to form a nip portion between the backup member and the endless belt;

a heater that is disposed inside the endless belt and is elongated in the longitudinal direction;

a reflection member disposed between the nip member and the heater and configured to reflect radiation heat from the heater;

a heat sensitive element configured to detect a temperature, the heat sensitive element being disposed between the reflection member and the nip member and facing the second surface of the nip member;

a temperature sensor having the heat sensitive element; and a stay that is elongated in the longitudinal direction and is disposed at an opposite side of the heater relative to the reflection member, wherein the stay has a first through-hole, wherein at least a portion of the temperature sensor is disposed in the first through-hole, wherein the stay has an inner peripheral surface defining the first through-hole, and wherein the fixing device further comprises a fifth adiabatic member provided between the inner peripheral surface of the stay defining the first through-hole and the temperature sensor.

10. A fixing device comprising:

an endless member;

a nip member having a first surface contactable to an inner peripheral surface of the endless member and a second surface opposite to the first surface;

a backup member configured to nip the endless member with the nip member to form a nip portion between the backup member and the endless member;

a heater disposed inside the endless member;

a mirror disposed between the nip member and the heater;

a temperature sensor comprising a heat sensitive element configured to detect a temperature, the heat sensitive element being disposed between the mirror and the nip member;

a wall member disposed between the mirror and the nip member, the wall member having a through hole, wherein the temperature sensor is inserted inside the through hole; and a spring, wherein the temperature sensor is disposed between the spring and the nip member, wherein the through hole of the wall member is disposed between the spring and the nip member, and wherein the spring urges the temperature sensor toward the nip member and urges the temperature sensor toward the nip portion.

11. The fixing device according to claim 10, wherein the wall member comprises a metallic stay disposed at an opposite side of the heater across the mirror, wherein the metallic stay has the through hole including a first through-hole, and wherein at least a portion of the temperature sensor is disposed in the first through-hole.

12. The fixing device according to claim 11, wherein the wall member further comprises a first resin wall disposed between the metallic stay and the nip member, wherein the first resin wall has the through hole including a second through-hole, and wherein at least a portion of the temperature sensor is disposed in the second through-hole.

13. The fixing device according to claim 12, wherein the temperature sensor comprises a supporting member disposed at an opposite side of the second surface of the nip member across the heat sensitive element and supporting the heat sensitive element, and wherein at least a portion of the supporting member is disposed in the second through-hole.

14. The fixing device according to claim 11, wherein the temperature sensor comprises a supporting member disposed at an opposite side of the second surface of the nip member across the heat sensitive element and supporting the heat sensitive element, and wherein at least a portion of the supporting member is disposed in the first through-hole.

15. A fixing device comprising:

an endless member;

a nip member having a first surface contactable to an inner peripheral surface of the endless member and a second surface opposite to the first surface;

a backup member configured to nip the endless member with the nip member to form a nip portion between the backup member and the endless member;

a heater disposed inside the endless member;

a mirror disposed between the nip member and the heater and configured to reflect radiation heat from the heater;

a thermal cut-off member electrically coupled to the heater, at least a portion of the thermal cut-off member being disposed between the mirror and the nip member;

a wall member disposed between the mirror and the nip member, the wall member having a through hole, wherein the thermal cut-off member is inserted inside the through hole; and a spring, wherein the thermal cut-off member is disposed between the spring and the nip member, wherein the through hole of the wall member is disposed between the spring and the nip member, and wherein the spring urges the thermal cut-off member toward the nip member and urges the thermal cut-off member toward the nip portion.

16. The fixing device according to claim 15, wherein the thermal cut-off member comprises at least one of a thermostat and a fuse.

17. The fixing device according to claim 16, wherein the wall member comprises a stay disposed at an opposite side of the heater relative to the mirror, wherein the stay has the through hole including a first through-hole, and wherein at least a portion of the thermal cut-off member is disposed in the first through-hole.

18. The fixing device according to claim 17, wherein the wall member further comprises a first adiabatic member disposed between the stay and the nip member, wherein the first adiabatic member has the through hole including a second through-hole, and wherein at least a portion of the thermal cut-off member is disposed in the second through-hole.

* * * * *